United States Patent [19]

Mori et al.

[11] 3,996,544

[45] Dec. 7, 1976

[54] CYLINDRICAL WINDING FOR INDUCTION ELECTRICAL APPARATUS

[75] Inventors: Etsunori Mori; Yoshitake Kashima; Fumio Nishikawa, all of Hitachi, Japan

[73] Assignee: Hitachi, Ltd., Japan

[22] Filed: Dec. 18, 1975

[21] Appl. No.: 641,931

[30] Foreign Application Priority Data

Dec. 23, 1974 Japan ..... 49-146804

[52] U.S. Cl. ..... 336/60; 336/70

[51] Int. Cl.[2] ..... H01F 27/10

[58] Field of Search ..... 336/60, 55, 58, 94, 336/69, 70, 84

[56] References Cited

FOREIGN PATENTS OR APPLICATIONS 2,019,103 11/1971 Germany ..... 336/60

*Primary Examiner*—Thomas J. Kozma

*Attorney, Agent, or Firm*—Craig & Antonelli

[57] ABSTRACT

A multi-layer winding comprising cylindrically-wound conductors and having different diameters are arranged concentrically. The layer windings are connected in series from inside to outside. Each layer winding has a layer insulator arranged on the inside thereof with a flange. Inwardly of the layer insulator and adjacent to the next inward layer winding is formed an oil gap functioning as a cooling-oil path. That oil-gap-equivalent part at and in the vicinity of the ends of the layer winding where the potential is maximum between adjacent layer windings is larger than the other parts thereof. This construction reduces the intensity of the electric field at the ends of each layer winding and eliminates partial discharge, thus improving the reliability and rendering the multi-layer winding compact and light in weight as a whole.

6 Claims, 4 Drawing Figures

CYLINDRICAL WINDING FOR INDUCTION ELECTRICAL APPARATUS

BACKGROUND OF THE INVENTION

1. Field of the Invention

This invention relates to a cylindrical winding used for induction electrical apparatus such as transformers, or more in particular to a multilayer winding in which the length of the oil gaps formed between adjacent layer windings is adjusted to reduce the electric field intensity at the edges of the layer windings.

2. Description of the Prior Art

It is well known that the high-voltage winding of such induction apparatus as transformers is subjected to oscillation of electrical potential when impressed with an impulse voltage such as lightning surge and switching surge which, in an extreme case, leads to the dielectric breakdown of the inductor involved. In order to improve the impulse voltage characteristics of the winding, it is common practice to arrange the winding to have larger series distributed electrostatic capacitance than the distributed earth electrostatic capacitance to achieve a substantially uniform, or linear potential distribution over the whole winding from one end to the other thereof.

Generally, when an impulse voltage is applied to a line terminal of the high-voltage winding, the initial characteristics of potential distribution due to such an impulse voltage are expressed as a function of $\alpha = \sqrt{Cg/Cs}$, where $Cg$ is the earth electrostatic capacity of the winding and $Cs$ is the series electrostatic capacity of the winding. As is well known, the potential distribution of the winding is more uniform the smaller the value of $\alpha$.

Typical high-voltage winding construction of transformers takes the form of interleaved disc windings or concentric cylindrical windings. It is also well known to those skilled in the art that, because of easiness in obtaining larger series electrostatic capacity of the winding, the cylindrical winding construction comprising a multi-layer winding is preferable, as will be described more in detail later.

The cylindrical winding assembly comprises a plurality of layer windings each of which is made by coiling a conductor in a suitable number of turns depending on the current capacity of the conductor and in a cylindrical form. The conductor may be a single flat-type wire with suitable insulation covering or a transposed wire made from a bundle of enamel-covered narrow flat-type strands twisted and collectively insulation-covered. The layer windings are made in cylindrical form with different diameters and arranged concentrically with each other. The conductor of each layer winding is connected at one end thereof in series with the conductor of an adjacent layer winding at the top or bottom thereof. The open end of the conductor of the innermost layer winding and the open end of the conductor of the outermost layer winding are connected respectively with neutral and high-voltage bushing terminals.

In such a cylindrical winding assembly, the series electrostatic capacity $Cs$ becomes larger, for the reasons as will be described hereinunder, thereby to reduce the value $\alpha$ which determines the initial characteristics of the impulse voltage on the windings. This is because a cylindrical winding assembly comprising a plurality of layer windings satisfies (a) and (b) of the following conditions for increasing the series electrostatic capacity of the winding assembly: (a) to increase the area of the surfaces of respective windings facing each other, (b) to decrease the distance between adjacent windings, and (c) to enlarge the charge voltage between adjacent windings. The cylindrical winding assembly, therefore, develops greater resistivity against impulse voltage than the disc winding assembly.

In spite of this advantage, the cylindrical winding assembly has the following problem: In what may be called an "oblique cylindrical winding assembly," in which the layer windings, some of which have a shape of frustum of a cone, are connected in series with each other at the top and bottom ends, alternately and shield rings are provided at the ends of the layer windings, provision is made to dispose layer insulators between the layer windings. One of the layer insulators which is disposed between the innermost layer winding and a winding such as the low voltage winding or the like is formed with a uniform thickness over the axial length thereof, while the remaining layer insulators which are disposed between the layer windings are formed with a cross-section in the form of wedge having tapered thickness such that the thicker portion of the layer insulator is disposed between the opposing portions of adjacent layer windings which are subjected to higher potential difference when energized. These layer insulators generally are made in such a manner that insulating paper such as kraft paper 0.1 to 0.2 mm thick is cut into a predetermined size and wound on each of the layer windings, when it has been formed, to shape according to the oblique winding method in which the insulating layer is thicker at one end than at the other end. One end of each layer insulator thus wound is bent so as to hang over the shield ring arranged at the ends of each winding for reducing the electric field intensity while at the same time maintaining a predetermined oil gap with the same, thereby forming a flange. Alternatively, the layer insulators may be combined with flanged insulating member, respectively.

In the conventional oblique winding method for making the layer insulators, the insulating material is wound so as to hold duct pieces axially of the winding between the layer winding and the formed layer insulator thereby forming therebetween an oil gap of predetermined size as oil path for cooling the winding. The width of the oil gap is uniform from the bottom to top of the winding, while the formed layer insulator is formed to have a wedge-shaped cross-section with a constant inclination, and therefore the layer insulator has, at the portion adjacent to the top of the winding, a larger thickness or higher dielectric strength than commensurated with the potential difference between adjacent layer windings. As a result, the potential difference is not uniformly shared by the layer insulator and the insulating oil at the end of the winding in the neighborhood of the shield ring facing the oil gap through the layer insulator and therefore the surface electric field at that part and the electric field of the oil gap itself have extremely increased intensity, thus causing partial discharge. In an extreme case, this may lead to a serious accident such as a dielectric breakdown.

Generally, the intensity E of a uniform electric field of the shield ring surface facing the oil gap is expressed as $$E = \frac{V}{do + \frac{\epsilon_o}{\epsilon_p} \times dp}$$

where V is the potential difference, *do* the gap width, dp the thickness of the layer insulator, $\epsilon_o$ the dielectric constant of the oil, and $\epsilon_p$ the dielectric constant of the layer insulator.

Usually, the dielectric constant $\epsilon_o$ of oil is smaller than the dielectric constant $\epsilon_p$ of the layer insulator, and therefore, the increased thickness of the layer insulator more than required will cause an increased electric field intensity of the oil gap, resulting in a great disadvantage in insulation design, the distance between adjacent layer windings $d(= do + dp)$ being constant.

The above-mentioned problem is not limited to the oblique cylindrical winding assembly but is encountered also by a typical cylindrical winding assembly provided with a cylindrical layer insulator arranged inside of each of the layer windings, which insulator has the same thickness over the entire axial length thereof and has flanges at the upper and lower ends thereof.

SUMMARY OF THE INVENTION

Accordingly, it is an object of the present invention to reduce the electric field intensity at the ends of the layer windings by adjusting the length of the oil gap provided between the windings making up a cylindrical winding assembly.

Another object of the invention is to greatly reduce the partial discharge which otherwise might occur at the ends of each layer winding of the cylindrical winding assembly, thus improving the reliability of insulation of the windings.

Still another object of the invention is to reduce the amount of the insulating material by effectively forming the layer insulator inside of each layer winding making up the cylindrical winding assembly, thus rendering the winding assembly compact and light in weight.

According to the invention, a plurality of layer windings each formed by a cylindrically coiled conductor and having a different diameter from the remaining layer windings are concentrically arranged. These layer windings are electrically connected in series one another from inside to outside. A layer insulator having a flange is provided inside of each of the layer windings. An oil gap which makes up cooling-oil path is formed between each winding and an adjacent layer insulator. In constructing such a cylindrical winding assembly, the conspicuous feature of the invention lies in that, by changing the shapes of the respective layer insulators, the width of the oil gap is enlarged at the parts adjacent to and near to the end portions of adjacent layer windings where the windings are subjected to a largest potential difference is enlarged as compared with the other parts of the oil gap, thereby achieving the abovedescribed objects of the invention.

DESCRIPTION OF THE PREFERRED EMBODIMENTS

Figure 1:
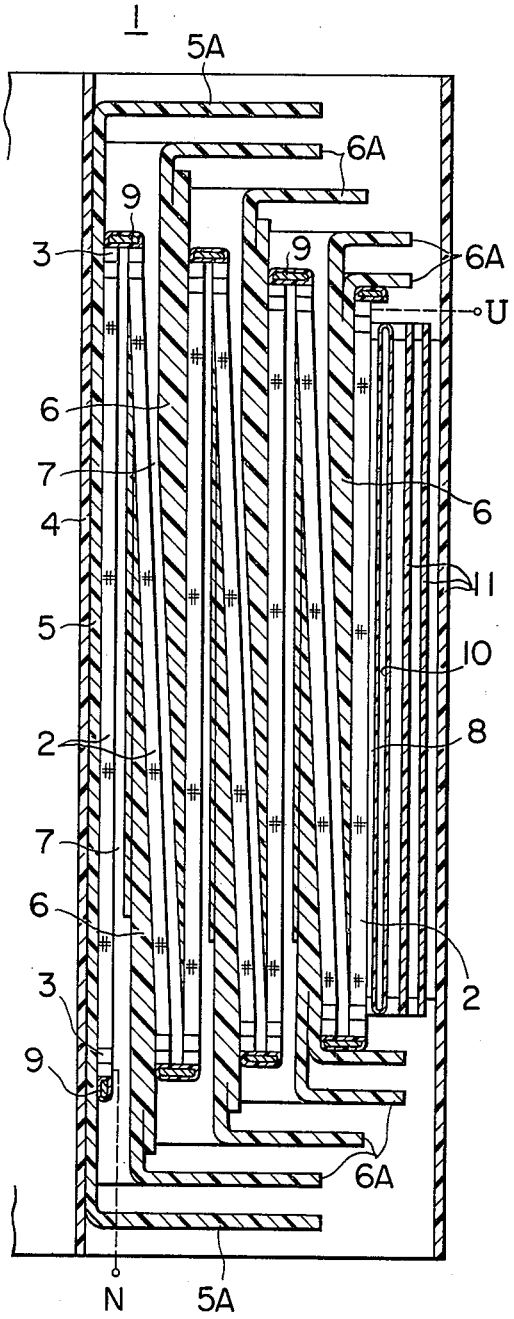
FIG. 1 is a longitudinal sectional view showing a cylindrical winding assembly for induction apparatus to which the present invention is applied.

The cylindrical winding assembly according to the invention will be described below with reference to the oblique cylindrical winding assembly shown in the drawings.

The cylindrical winding assembly shown in FIG. 1 is used as a high-voltage winding assembly comprising layer windings concentrically arranged on the main leg of an iron core (not shown) together with a low-voltage winding assembly (not shown) and, if any, other windings.

Reference characters U and N show terminals on the line side and neutral-point side of the cylindrical winding assembly for high-voltage use, respectively.

The high-voltage cylindrical winding assembly 1 comprises, as alreacy described and shown in FIG. 1, a plurality of layer windings 2 each formed by cylindrically winding an insulated conductor 3. Each of the layer windings 2 has shield rings 9 at the top and bottom thereof for reducing the electric field. The outer ones of the concentrically-arranged windings have progressively larger diameters and shorter axial length than the inner ones. Further, the cylindrical winding assembly 1 is arranged to have two different types of layer windings alternately and concentrically disposed. More specifically, the innermost layer winding 2 leading to the terminal N is such that its conductor 3 begins to be wound from the bottom into the form of cylinder having uniform diameter. In the next innermost layer winding, the conductor 3 starts to be wound from top into a cylindrical shape having a progressively larger diameter downward in such a manner that the distance between adjacent layer windings is increased with increasing of the potential difference therebetween, thus forming what may be called an oblique cylindrical winding assembly having a concentric alternate arrangement of a predetermined number of these two types of layer windigs. Each of the layer windings 2 is connected in series with an adjacent layer winding at upper or lower end thereof. The connection between adjacent, layer windings is usually done after the concentric arrangement of the layer windings 2 has been finished, but may be omitted if all the layer windings 2 are formed by winding a single continuous conductor in a series of such windings.

The layer windings 2 vary in axial length to be progressively shorter from the longest innermost one to the shortest outermost one as mentioned above and their axial lengths are determined taking into consideration, as well known, the voltages induced at the ends of the layer windings when impressed with an impulse voltage and the insulation against the ground. The layer insulator 5 or 6 made of thin insulating paper about 0.1 to 0.2 mm thick is provided inside of each layer of the multilayer winding 2 as described more fully later. The innermost layer insulator 5 is located adjacent to an insulating cylinder 4 used also as a core, inwardly of the innermost layer winding 2, and has a uniform thickness over the entire length thereof. Flanges 5A for insulating the ends of the windings are provided at top and bottom of the innermost layer insulator 5. The other layer insulators 5 which are disposed inside of the layer windings 2 other than the innermost one are formed in wedge-shaped cross-section to have tapered thickness whose inclination is corresponding to the inclination in change along the axial length of the potential difference between adjacent layer windings, the flanges 6A being provided at the thicker ends thereof for insulating the particular ends. Thus, the wedge-shaped layer insulators 6 have such flanges 6A disposed alternately at the top and bottom of the insulators 6, and the flanges 5A and 6A are superposed in spaced relation through a plurality of horizontal duct pieces (not shown) therebetween. Between the layer insulator 5 and the inner layer winding 2 adjacent thereto, there are provided oil gaps 7 making up cooling-oil path defined by straight duct pieces (not shown) made of press board or the like. A cylindrical shield 10 and a plurality of insulating cylinders 11 are arranged concentrically in that order in such a manner as to surround, through oil gaps 8 forming cooling-oil path, the outermost layer winding 2 leading to the terminal U. The cylindrical shield 10 is capable of improving the impulse voltage characteristics of the cylindrical winding 1 against the impulse voltage coming in from the line terminal U and is connected to the same potential as the lead wire leading to the ordinary terminal U or the end of the outermost layer winding 2 where the potential is highest.

The outermost layer insulator and the layer insulator outermost but one 6 each has a couple of flanges 6A extending over the top or bottom of the cylindrical shield 10 respectively, thus making it possible to provide a sufficiently long creepage distance between the outer layer winding high in potential and any other part to prevent dielectric breakdown due to surface discharge along the creeping distance. The layer insulators are made by winding, after forming each of the layer windings 2, thin insulating paper into the shape of a cylinder of predetermined size, cutting the ends of the cylindrically wound insulators protruded beyond the layer windings 2 into strips and bending the strips to form the flanges 6A and 5A of the insulators, one by one, successively from the outermost one, as combining discs of press board if necessary. In this way, both the flanges 6A of the outermost layer insulator and the layer insulator outermost but one 6 are easily formed.

Figure 2:
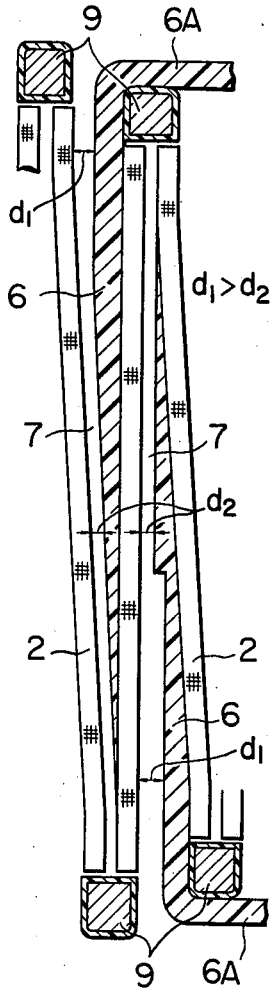
FIG. 2 is a longitudinal sectional view showing part of the cylindrical winding assembly shown in FIG. 1.
Figure 3:
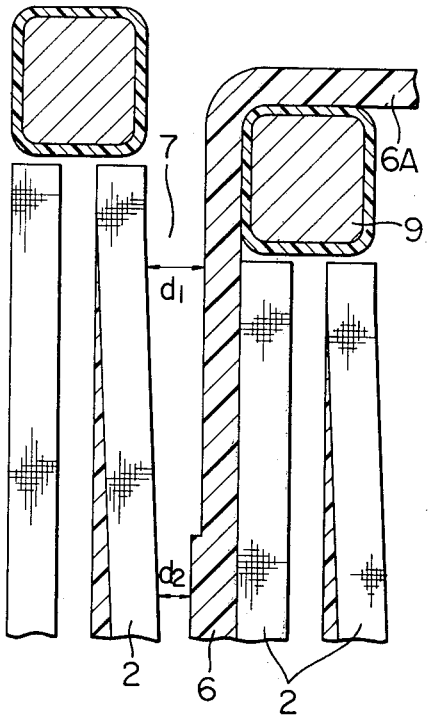
FIGS. 3 and 4 are enlarged longitudinal sectional views showing different embodiments of the ends of the cylidrical winding assembly according to the present invention.

The oil gap 7 is provided for the purpose of cooling the layer windings 2 and its size is determined taking heat generation into consideration. According to the invention, a special contrivance is incorporated in the formation of the oil gap of the winding assembly, as will be described below with reference to FIGS. 2 and 3. This invention is characterized in that, in arranging concentrically the layer windings 2 each having upper and lower shield rings 9 and forming the layer insulators 6 inside the respective layer windings 2 by winding insulating paper, the oil gap kept in predetermined width by straight duct pieces (not shown) is formed in such a manner that the width $d_1$ of the oil-gap-equivalent part near the ends of the windings where the potential between adjacent layer windings 2 is highest is rendered larger than the width $d_2$ at other parts of the oil gap such as intermediate parts thereof in order to reduce the intensity of the electric field at the ends of the windings.

As will be obvious from the above-mentioned equation determining the electric field intensity E, the intensity is reduced by enlarging the width $do$ of the oil gap 7 as compared with the thickness dp of the layer insulator 6. Accordingly, by rendering the width $d_1$ of the oil-gap-equivalent part at the ends of the layer windings greater than the oil gap width $d_2$ of the other parts thereof, the intensity of the electric field at the ends of the layer winding where the shield ring 9 is located is reduced considerably.

In the above-mentioned embodiment, means for enlarging the width $d_1$ of the oil-gap-equivalent part near the ends of the windings consist in eliminating part of the layer insulator 6 near the ends of the layer windings 2, so that the thickness of the particular part of the layer insulator 6 is minimized in view of the required dielectric strength thereby to reduce the electric field intensity applied to the oil gap 7.

Naturally, the width of the oil gap 7 is determined in such a manner as to supply the cooling oil in sufficient amount to disperse the heat generated by the layer windings 2. In this connection, the width $d_1$ of the oil-gap-equivalent part at the thicker ends of the layer insulator 6 is rendered 1.3 to 1.8 times the width $d_2$ of the other oil gap parts including the centeral part thereof depending on the maximum potential at the ends of the layer windings 2 on the inside of which the layer insulators 6 are provided. However, it is usually enough to make the oil gap having a width $d_1$ approximately 1.5 times the oil gap width $d_2$ and a length of the wider part approximately one-fifth to one-seventh of the length of the layer winding, for providing satisfactory layer insulation as well as reduction of the electric field intensity at the winding ends.

By reducing the electric field intensity at the ends of the layer windings 2 in the above-mentioned manner, partial discharge at the particular ends can be considerably reduced, thereby almost preventing a dielectric breakdown, resulting in improved insulation characteristics of the cylindrical winding assembly. Also, since part of the layer insulator 6 is made thinnwer thereby to make the width of the oil gap at that part larger, as much insulating material may be saved while at the same time contributing to the compactness and light weight of the winding assembly.

Figure 4:
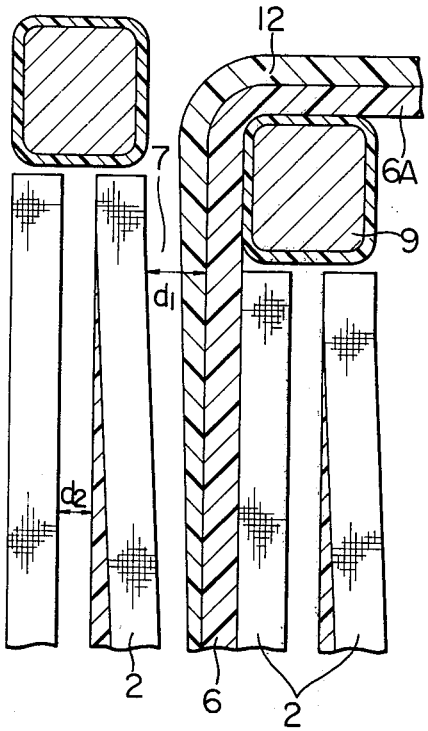

In order to achieve the same advantage as the foregoing embodiments, the cylindrical winding assembly according to another embodiment of the invention shown in FIG. 4 is so constructed that, in order to reduce the electric field intensity at the ends of the layer windings 2, part of the layer insulator 6 is omitted and in its place, an insulating material 12 having a low dielectric constant equal or near to that of the insulating oil is inserted or wound. Thus the combination of the oil gap serving as a cooling-oil path and the insulating material 12 having a low dielectric constant is effective to make that part of the oil gap as if its width is increased to $d_1$, i.e. an oil-gap-equivalent part of the width $d_1$.

The insulating material 12 having a low dielectric constant making up part of the oil-gap-equivalent part is made of an oil resistant material having almost the same dielectric constant as oil, such as Mylar.

In the case where part of the layer insulator 6 is omitted and replaced by an insulating material having a low dielectric constant, the required dielectric strength at the ends of the layer windings 2 is given by the combination of the layer insulator 6 and the insulating material 12. Therefore, the layer insulator 6 may be reduced in thickness as compared with the layer insulator shown in FIGS. 2 and 3, thus further reducing the sizes and weight of the whole winding assembly.

Even though the above description of the embodiments is with reference to what may be called the oblique cylindrical winding assembly comprising a multilayer winding and layer insulators wound obliquely, the present invention may be applied with the same effects to a cylindrical winding assembly having layer insulators of uniform thickness over their axial length, as well as to a helical winding assembly comprising a multilayer winding made of helically-wound conductors as well as to other winding assemblies.

We claim:

1. A cylindrical winding assembly for induction electrical apparatus comprising; a plurality of layer windings having different diameters and being arranged concentrically, each of said layer windings including a conductor cylindrically wound, said layer windings being connected in series from the innermost one to the outermost one thereof; and a plurality of layer insulators respectively arranged inside of said plurality of layer windings, each of said layer insulators having at least a flange at an end thereof; an oil gap being formed between each of said layer insulators and one of said layer windings inwardly adjacent to said each layer insulator, said oil gap serving as path of cooling oil, said oil gap having an oil-gap-equivalent part which is formed at the ends thereof where the electric potential difference between adjacent layer windings is greatest and has a greater width than the other parts of said oil gap.

2. A cylindrical winding assembly for induction electrical apparatus according to claim 1, in which said oil-gap-equivalent part at the ends of said layer windings comprises a gap for permitting cooling-oil flow and a space where insulating material having a dielectric constant similar to that of the oil is applied.

3. A cylindrical winding assembly for induction electrical apparatus comprising; a plurality of layer windings arranged concentrically and having different diameters, adjacent ones of said layer windings being connected in series at the upper and lower ends thereof alternately one another from the innermost one to outermost one thereof; an insulating cylinder provided inside of said innermost layer winding; and a plurality of layer insulators respectively arranged inside of said plurality of layer windings, the layer insulator inside of said innermost layer winding being provided with a couple of flanges on the upper and lower ends thereof each of the other layer insulators being tapered in section and having a flange at an end thereof, said sectionally-tapered layer insulators being arranged in such a manner that said flanges are positioned at the upper and lower ends of said sectionally-tapered layer insulators alternately; an oil gap being formed between each of said layer insulators and one of said layer windings inwardly adjacent to said each layer insulator, said oil gap serving as a path of cooling oil, said oil gap having a part which is formed at the end thereof where the electric potential difference between adjacent layer windings is greatest and has a greater gap width than the other pats of said oil gap.

4. A cylindrical winding assembly for induction electrical apparatus according to claim 3, in which the width of said part having a wider width is approximately 1.3 to 1.8 times the width of the other parts of said oil gap.

5. A cylindrical winding assembly for induction electrical apparatus according to claim 3, further comprising a cylindrical shield arranged concentrically with and outwardly adjacent to said outermost layer winding with an oil gap therebetween for serving as cooling-oil path.

6. A cylindrical winding assembly for induction electrical apparatus comprising; a plurality of layer windings arranged concentrically and having different diameters, said layer windings being connected in series at the upper and lower ends thereof alternately one another from the innermost to outermost ones thereof; an insulating cylinder provided inside of said innermost layer winding; a plurality of layer insulators respectively arranged inside of said plurality of layer windings, the layer insulator inside of said innermost layer winding being provided with a couple of flanges on the upper and lower ends thereof, each of the other insulators being tapered in section and having a flange at one end thereof, said sectionally-tapered layer insulators being arranged in such a manner that said flanges are positioned at the upper and lower ends of said sectionally-tapered layer insulators alternately, an oil gap being formed between each of said layer insulators and one of said layer windings inwardly adjacent to each said layer insulator, said oil gap serving as a path of cooling oil, each of said layer insulators having a thicker part at one end thereof where the electric potential difference between adjacent layer windings is greatest, with the corresponding part of the oil gap being greater in width than the other parts of said oil gap; and a cylindrical shield arranged on said outermost layer winding concentrically therewith through an oil gap serving as a cooling-oil path, each of the outermost layer insulator and the layer insulator outermost but one having an additional flange which is formed at the end thereof where said first mentioned flange is formed with a predetermined distance therebetween, said additional and first mentioned flanges being opposing to the respective one of the upper and lower ends of said cylindrical shield.

* * * * *